US010557448B2

(12) United States Patent
Walsh et al.

(10) Patent No.: US 10,557,448 B2
(45) Date of Patent: Feb. 11, 2020

(54) DRIVESHAFT ASSEMBLY WITH INDEXING MEANS

(71) Applicant: DELPHI TECHNOLOGIES IP LIMITED, St. Michael (BB)

(72) Inventors: Aaron Walsh, Upton (GB); Michael A. Willis, Bozeat (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 273 days.

(21) Appl. No.: 15/510,361

(22) PCT Filed: Aug. 12, 2015

(86) PCT No.: PCT/EP2015/068583
§ 371 (c)(1),
(2) Date: Mar. 10, 2017

(87) PCT Pub. No.: WO2016/037790
PCT Pub. Date: Mar. 17, 2016

(65) Prior Publication Data

US 2017/0260953 A1 Sep. 14, 2017

(30) Foreign Application Priority Data

Sep. 10, 2014 (GB) ..... 1415964.4

(51) Int. Cl.
*F02M 65/00* (2006.01)
*F02M 59/10* (2006.01)
(Continued)

(52) U.S. Cl.
CPC ..... *F02M 65/00* (2013.01); *F02M 57/023* (2013.01); *F02M 59/102* (2013.01); *F02M 59/30* (2013.01); *F02M 2200/8015* (2013.01)

(58) Field of Classification Search
CPC .... F02M 59/027; F02M 59/102; F02M 59/24; F02M 65/00; F01B 9/06; F01B 3/0023;
(Continued)

(56) References Cited

U.S. PATENT DOCUMENTS 4,037,467 A * 7/1977 Emerson ..... F02M 65/00 73/114.45
5,125,372 A 6/1992 Gondek
(Continued)

FOREIGN PATENT DOCUMENTS

CN 103061900 A 4/2013
FR 552028 A 4/1923
(Continued)

*Primary Examiner* — Eric S. McCall
*Assistant Examiner* — Timothy P Graves
(74) *Attorney, Agent, or Firm* — Joshua M. Haines

(57) ABSTRACT

A driveshaft assembly, for example in an Electronic Unit Injector, Unit Injector or Electronic Unit Pump testing machine, wherein an indexing arrangement, such as complementary external and internal splines, enables a cam to be mounted on a shaft at a number of discreet positions, each providing a different offset of a central axis of the base cylinder section from a central axis of the shaft, each position providing a different maximum lift value of a plunger in contact with the cam, directly or via a rocker arm.

7 Claims, 9 Drawing Sheets

(51) Int. Cl.
*F02M 57/02* (2006.01)
*F02M 59/30* (2006.01)

(58) Field of Classification Search
CPC ..... F01B 2009/061; F01B 2009/063; F01B 2009/065; F01B 2009/066; F01B 2009/068; B29C 66/82265; F04B 53/006; F04B 39/0094; F04B 1/0413; F04B 9/042; F01L 1/047; F01L 2001/0473; F04C 2/102; F02B 2275/34; F02B 33/06
See application file for complete search history.

(56) References Cited

U.S. PATENT DOCUMENTS

| | | | | |
|---|---|---|---|---|
| 8,122,811 | B2 | 2/2012 | Takamizawa et al. | |
| 8,887,694 | B2 | 11/2014 | Hada et al. | |
| 2006/0064872 | A1 | 3/2006 | Shirai | |
| 2012/0243991 | A1* | 9/2012 | Han | H02P 9/04 416/9 |
| 2014/0109851 | A1* | 4/2014 | Kirbach | F01L 1/053 123/90.15 |

FOREIGN PATENT DOCUMENTS

| | | | |
|---|---|---|---|
| GB | 191516182 | A | 7/1916 |
| GB | 2121908 | A | 1/1984 |
| JP | 52143003 | U | 10/1977 |
| JP | 07167018 | A | 7/1995 |
| JP | 09177635 | A | 7/1997 |

* cited by examiner

DRIVESHAFT ASSEMBLY WITH INDEXING MEANS

CROSS REFERENCE TO RELATED APPLICATIONS

This application is a national stage application under 35 USC 371 of PCT Application No. PCT/EP2015/068583 having an international filing date of Aug. 12, 2015, which is designated in the United States and which claimed the benefit of GB Patent Application No. 1415964.4 filed on Sep. 10, 2014 the entire disclosures of each are hereby incorporated by reference in their entirety.

TECHNICAL FIELD

The present invention relates to a driveshaft assembly, and more specifically to a cam and shaft for a driveshaft assembly.

BACKGROUND OF THE INVENTION

Fuel pumping and pressurising plungers of Electronic Unit Injectors (EUI), Unit Injectors (UI) and Electronic Unit Pumps (EUP), are operated in a reciprocating manner. In a known driveshaft arrangement or assembly 1, as illustrated in FIGS. 1*a* and 1*b*, reciprocating motion of a plunger 90, as indicated by arrow P, is caused by a rotating cam 2 located on a shaft 12. The cam 2 is formed of a base cylinder section 8, and an integral further section 10, protruding from part of the circumference of the base cylinder section 8. The cam 2 therefore has an outer surface 4 defined partly by the outer surface 4*a* of the base cylinder 8, and partly by the outer surface 4*b* of the further section 10.

The cam 2 operates on a plunger 90, either directly (as illustrated in the FIGS. 1*a* and 1*b*), or indirectly via a pivoting rocker arm (not shown). Lift is transferred to the plunger 90 or rocker arm in the direction of arrow L, via a lift point 6 on the outer surface 4 of the cam 2, where the outer surface 4 of the cam contacts with the plunger 90 (or rocker arm). In the orientation of FIGS. 1*a* and 1*b*, point 6 is the uppermost point of the outer surface 4 cam 2.

The cam 2 rotates about a centre of rotation, defined by a longitudinal central axis 14 of the shaft 12, which is coincident with a central axis 70 of the base cylinder section 8. As the cam 2 rotates with the shaft 12, the contact point between the cam 2 and the plunger 90, moves around the outer surface 4 of the cam, i.e. lift point 6 moves relatively around the outer surface 4 of the cam 2.

As illustrated in FIGS. 1*a* and 1*b*, the instantaneous lift L of the cam 2 is calculated as below:

$$L=A-B;$$

where A is the distance from a central axis 14 of the shaft 12 to the lift point 6, and B is the distance from the central axis 14 of the shaft 12 to the external surface 4*a* of the base cylinder section 8, i.e. a radius of the base cylinder section 8.

During part of the rotation cycle, when the lift point 6 occurs on the external surface 4*b* of the further section 10, the distance A will vary in accordance with the external profile 4*b* of the further section 10. During the part of the rotation cycle when the lift point 6 occurs on the external surface 4*a* of the base cylinder section 8, distance A will be constant and will be equal to distance B.

FIG. 1*a* illustrates a rotational position of the cam 2 which provides maximum lift, Lmax, i.e. lift point 6 is at a maximum distance from the centre 14 of the shaft 12, and distance A is therefore maximised.

FIG. 1*b* illustrates a rotational position of the cam 2 providing minimum lift, i.e. lift point 6 is at a minimum distance from the centre 14 of the shaft 12, and distance A is therefore minimised. In this position, A and B are equal, therefore the minimum lift Lmin is zero.

Typically, the prior art embodiment of FIGS. 1*a* and 1*b* also provides a constant plunger rate period. A known disadvantage of the prior art embodiment such as that illustrated in FIGS. 1*a* and 1*b* is that the maximum lift Lmax of the driveshaft assembly 1, and therefore the travel of the plunger 90, is predetermined and fixed, as each driveshaft assembly has a set value of B and set maximum value of A. To obtain a different value for the travel of the plunger 90, it is necessary to disassemble the driveshaft assembly 1 by removing the cam 2 from the shaft 12, and replacing it with an alternative cam having a different external profile, i.e. a different value of B and/or maximum A, and/or by replacing the rocker arm or changing the pivot point of the rocker arm.

Accordingly, in prior art embodiments, it is difficult to accommodate the differing plunger travel requirements. For example, it is difficult to accommodate the specific lift range requirements of different EUI, UI and EUP families, which could typically range from 9 mm to 19 mm.

SUMMARY OF THE INVENTION

It is an object of the present invention to provide an improved driveshaft assembly which at least mitigates the above mentioned problems.

Accordingly the present invention comprises, in a first aspect, a driveshaft assembly.

The present invention enables different values of maximum lift to be achieved using a single cam and shaft combination, i.e. a variable plunger lift is enabled for a single cam and shaft combination. Accordingly, a required value of maximum lift can be selected by use of the same cam and shaft, avoiding the need to use a multiple cam and/or rocker arm combinations to achieve different values of maximum lift.

The offset value may vary between zero and a maximum offset value.

The indexing means may comprise splines. In one embodiment, the splines comprise a first annular set of splines provided on an internal surface of the through bore of the cam, which correspond with a second annular set of splines provided on a section of the shaft, wherein a centre of a circumference of the splines is offset from the central axis of the shaft, and wherein the cam is a push fit onto the shaft, and wherein the plurality of rotational positions comprise a plurality of discreet rotational positions.

The driveshaft assembly may further comprise a position indicator, to indicate a relative position at which the cam has been assembled onto the shaft.

In a further aspect, the present invention comprises a driveshaft and plunger assembly, comprising a driveshaft assembly in accordance with the first aspect of the present invention, and a plunger arranged for reciprocating movement caused by lift imparted by the cam during rotation of the shaft.

The driveshaft and plunger assembly may further comprise a rocker arm, wherein lift is imparted to the plunger by the cam to the plunger via the rocker arm.

In a further aspect, the present invention comprises a machine for testing a fuel injectors or pump, such as an UI, EUI or EUP, comprising a driveshaft assembly in accordance with the first aspect of the present invention, wherein the driveshaft assembly causes reciprocating movement of a plunger of the fuel injector or pump.

The present invention provides a simpler and cheaper solution than prior art driveshaft assemblies.

BRIEF DESCRIPTION OF THE DRAWINGS

The present invention is now described by way of example with reference to the accompanying drawings in which.

Figure 9:
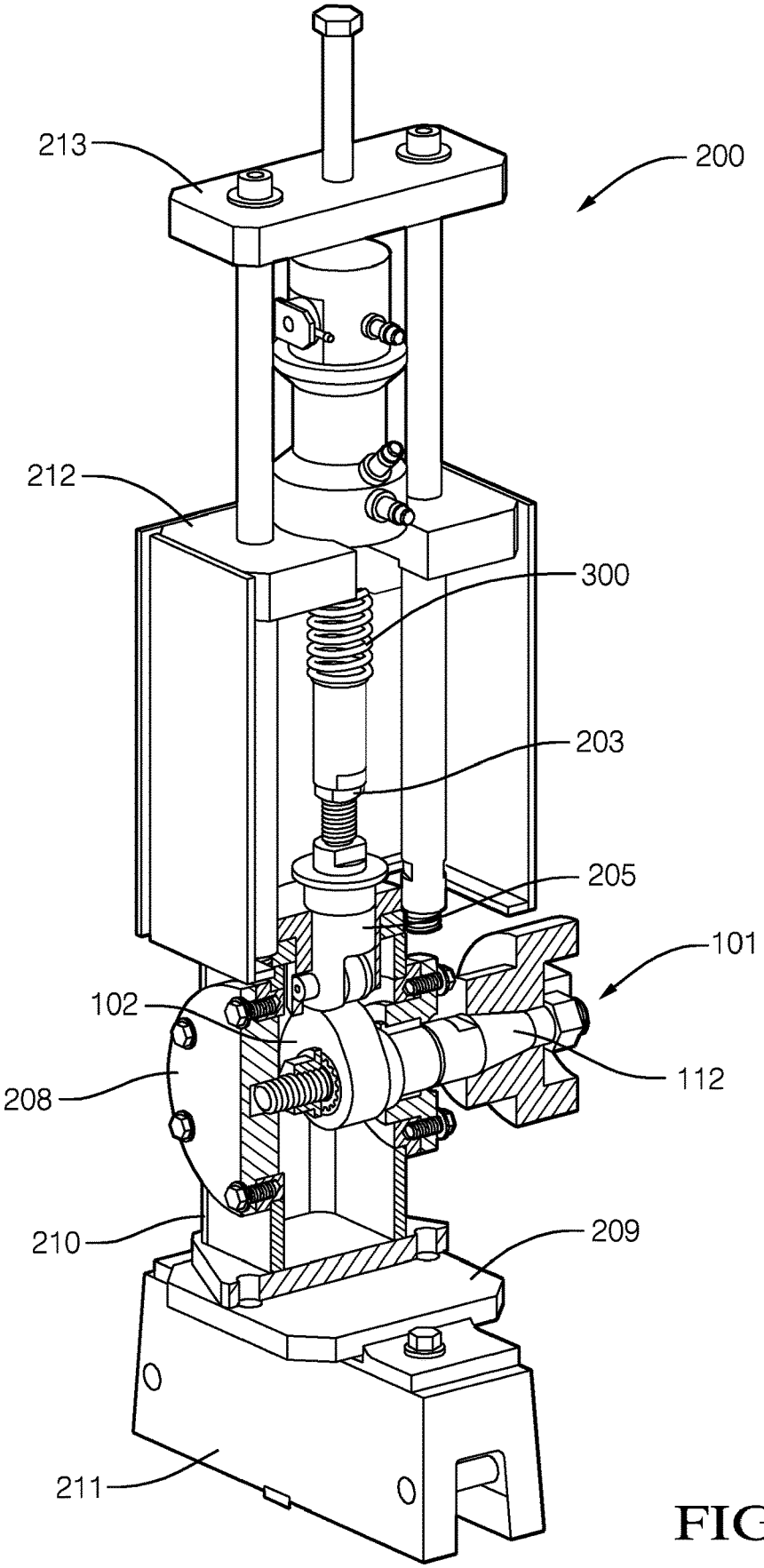

FIG. 9 is an isometric view of a testing machine in accordance with the present invention.

DESCRIPTION OF THE PREFERRED EMBODIMENTS

Figure 1A:
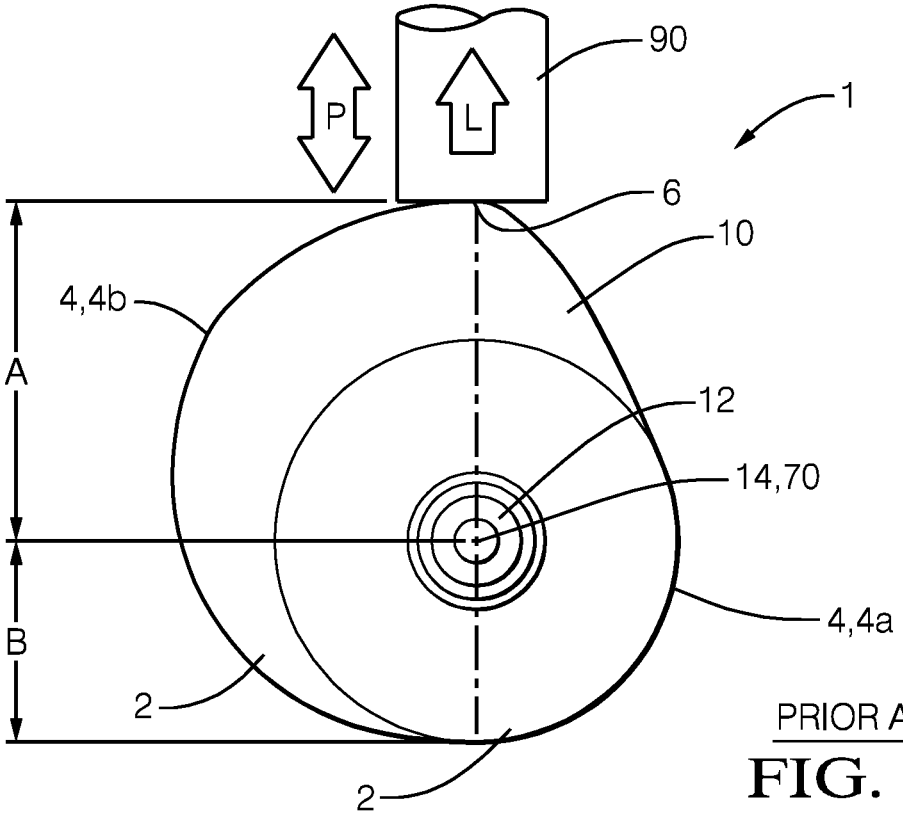
PRIOR ART FIG. 1a
FIGS. 1*a* and 1*b* illustrate a known driveshaft arrangement.
Figure 1B:
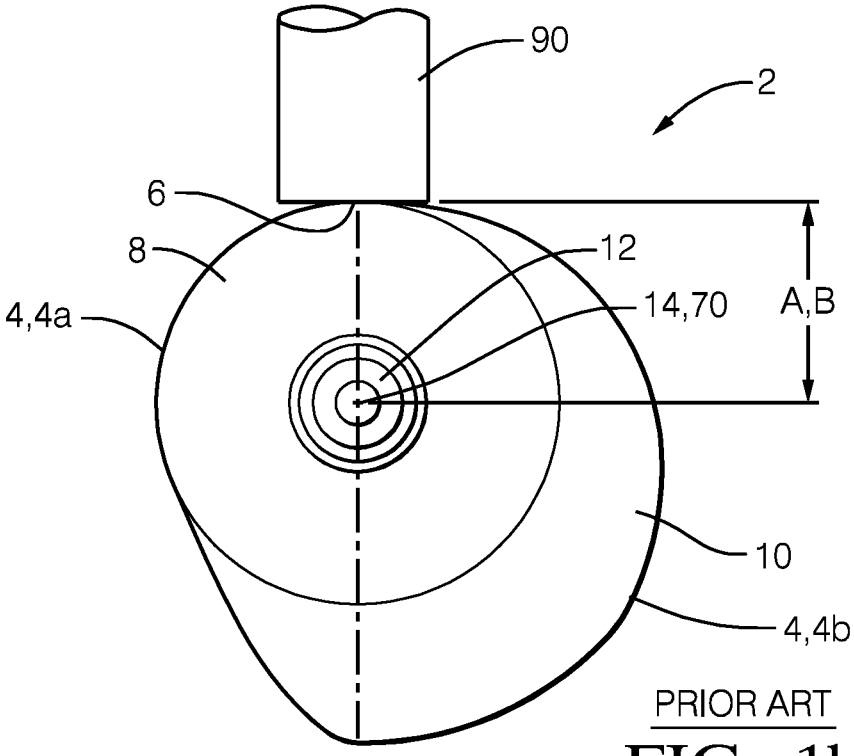
PRIOR ART FIG. 1b
Figure 2:
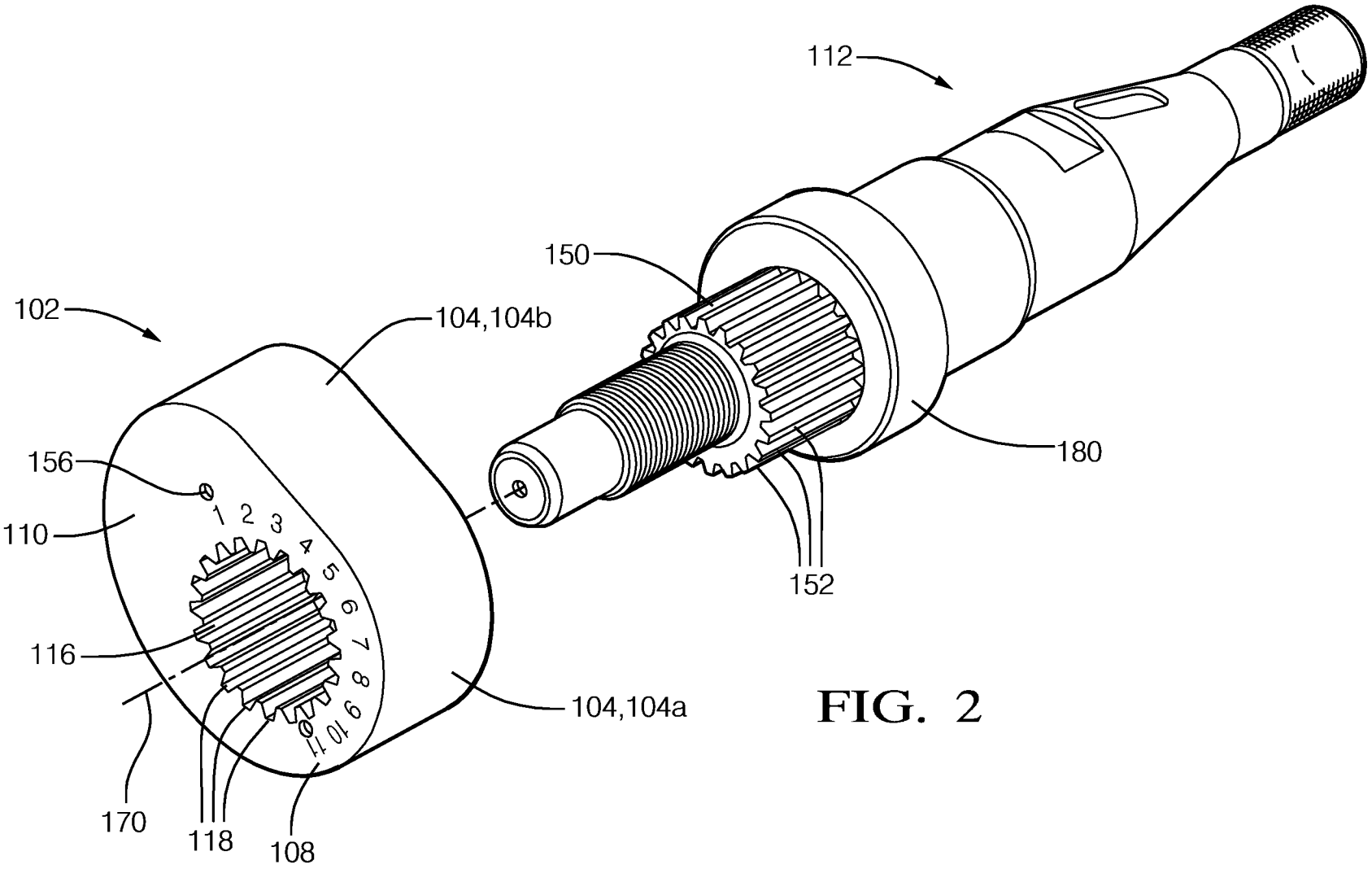
FIG. 2 is an exploded view of a driveshaft assembly in accordance with the present invention.

Referring initially to FIG. 2, the present invention comprises a driveshaft assembly 100 comprising a cam 102 and a shaft 112. The cam 102 comprises a base cylinder section 108, having a longitudinal central axis 170, and an integral further section 110, protruding from part of the circumference of the base cylinder section 108. An outer surface 104 of the cam 102 is defined by an outer surface 104*a* of the base cylinder section 108, and an outer surface 104*b* of the further section 110.

In the illustrated embodiment, the driveshaft assembly 100 is arranged to act upon a reciprocating component comprising a plunger 190 (shown in FIGS. 3*a*, 3*b*, 5*a*, 5*b*, 7*a* and 7*b*).

A longitudinally extending bore 116 is provided through the base cylinder section 108.

The bore 116 is provided with a first set of splines, comprising a plurality of internal splines 118 defined by a plurality of troughs and peaks.

An annular section 150 of the shaft 112 is provided a second set of splines, comprising a plurality of external splines 152, defined by a plurality of peaks and troughs. The annular section 150 is eccentric with the shaft 112, i.e. the central axis of the splines 152 is offset from a central axis 114 of the shaft 112.

On assembly of the driveshaft assembly 100, the cam 102 is pushed onto the shaft 112, until the splines 118 of the cam 102 are located over the external splines 152 of the shaft 112.

The external splines 152 of the shaft 112 cooperate with the internal splines 118 provided on the cam bore 116, such that the cam 102 is a push fit onto shaft 112.

An annular section 180 of the shaft 112 (shown on FIG. 2), which is of greater diameter that of the bore 116 of the cam 102, provides a stop, ensuring that the cam 102 and shaft 112 are located correctly with one another after the cam 102 has been pushed onto the shaft 112.

Figure 3A:
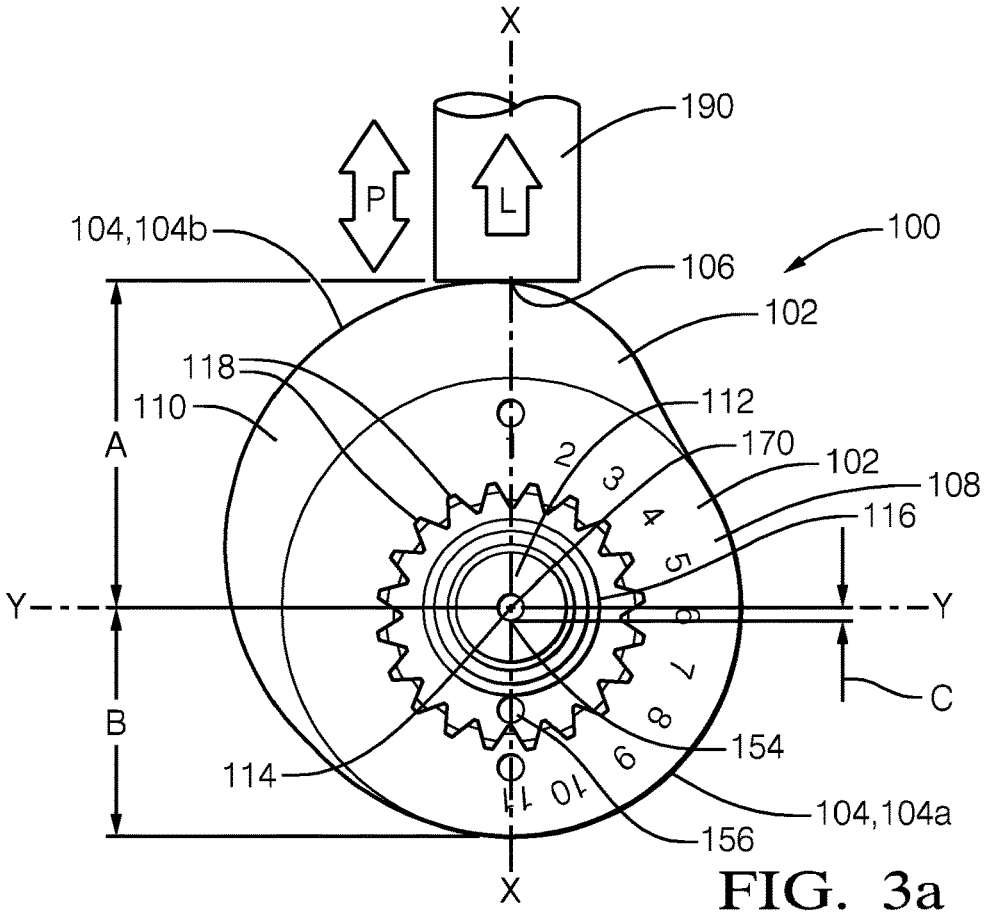
FIGS. 3*a* and 3*b* are end views of the driveshaft assembly of FIG. 2 wherein the cam is located on the shaft in a first, a minimum Lmax lift position.

On operation of the driveshaft, rotation of the shaft 112 causes rotation of the cam 102, which acts upon the plunger 190 (FIGS. 3*a*, 3*b*, 5*a*, 5*b*, 7*a* and 7*b*) at a lift point 106, thereby imparting lift to the plunger 190 and causing the plunger 190 to move in a reciprocating movement, in the directions of arrow P (shown on FIG. 3*a*).

The splines 118 of the cam 102, together with the splines 152 of the shaft 112, form a splined section 162, which forms an indexing means. In this embodiment illustrated in the Figures, the indexing means is annular and cylindrical. Due to the eccentricity of the annular section 150 with the shaft 112, a central axis 154 of the splined section 162 of the assembled driveshaft assembly 100 is offset from the central axis 114 of the shaft 112, by a distance C, as indicated in the Figures. In other words, a circumference of the indexing means is eccentric with the shaft 112.

The indexing means allow the cam 102 to be located on the shaft 112 at a number of discreet positions, each of which provides a different maximum value of lift, Lmax. (The calculation and variation of Lmax is described in greater detail below).

Three central axes are defined above (as illustrated in FIGS. 3, 3*b*, 5*a*, 5*b*, 7*a* and 7*b*):

a central axis 170 of the base cylinder section 108;

a central axis 114 of the shaft 112;

a central axis 154 of the splined section 162.

Figure 5A:
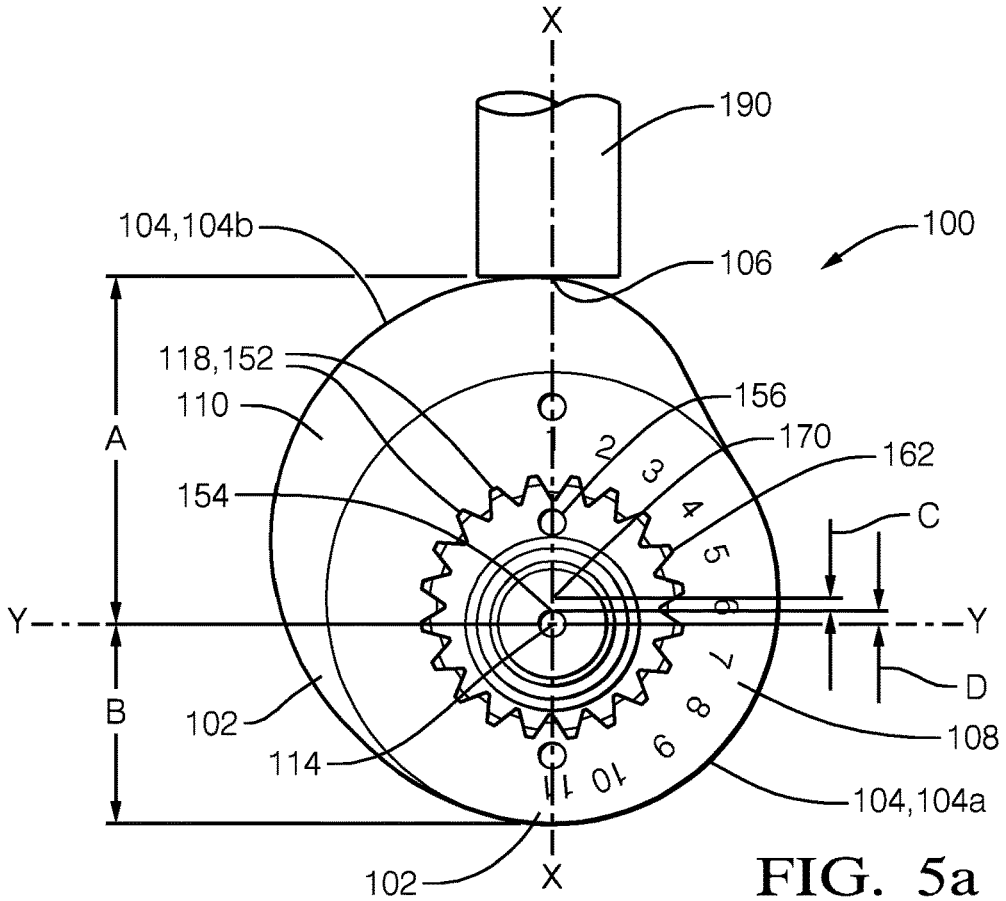
FIGS. 5*a* and 5*b* are end views of the driveshaft assembly of FIG. 2, in which the cam is located on the shaft in a second, maximum Lmax lift position.
Figure 7A:
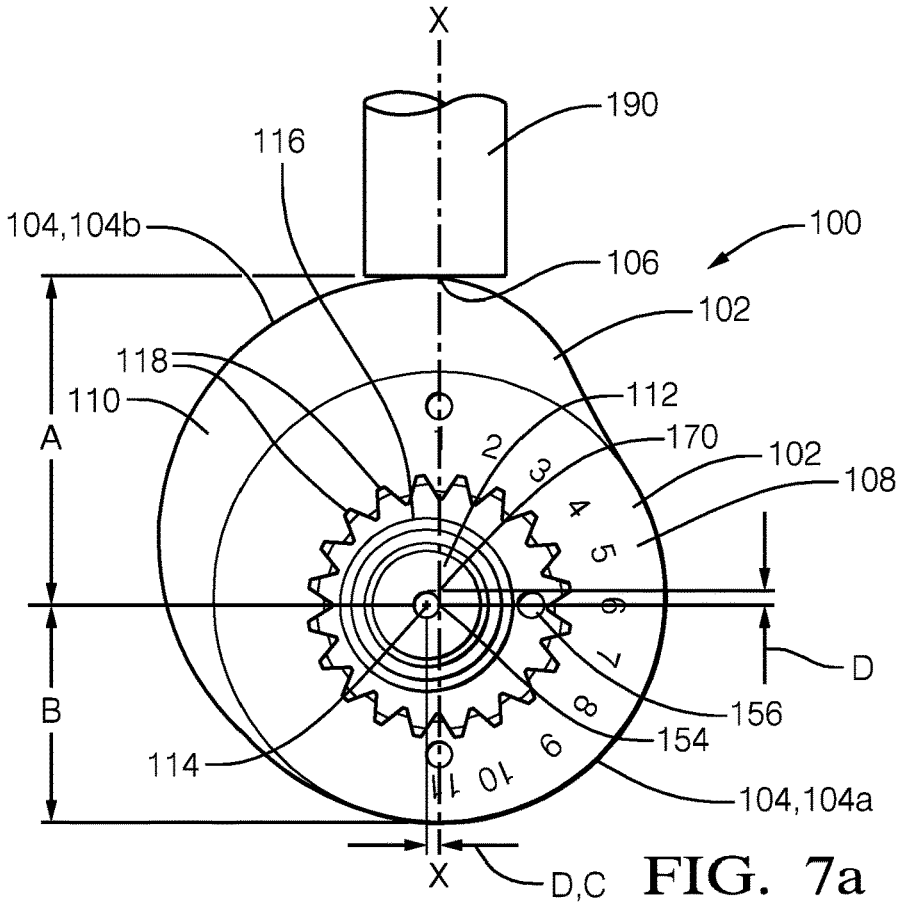
FIGS. 7*a* and 7*b* are end views of the driveshaft assembly of FIG. 2, in which the cam is positioned on the shaft at a third, mid-Lmax position.

As above, the central axis 154 of the splined section 162 is offset from the central axis 114 of the shaft 112, by distance C, in all arrangements of the cam 102 and shaft 112, i.e. at all indexed positions. However, the central axis 170 of the base cylinder section 108 from the central axis 114 of the shaft 112 can be varied between zero and D (D is illustrated in FIGS. 5*a* and 7*a*), in either or both of the X and Y axes (indicated in the Figures).

Each discreet position at which the cam 102 can be located on the shaft 112 provides a different offset value D, which determines the maximum value of lift, Lmax.

A position indicator 156 (shown in FIGS. 3*a*, 3*b*, 5*a*, 5*b*, 7*a* and 7*b*), is provided to indicate the relative position of the cam 102 on the shaft 112. In the illustrated embodiment, eleven positions of the cam 102 relative to the shaft 112 are indicated by numerals 1 to 11; each of these positions provides a known value of Lmax and therefore a known value of travel of the plunger 190.

As illustrated in FIGS. 3*a*, 3*b*, 5*a*, 5*b*, 7*a* and 7*b*, the instantaneous lift L of the cam 102 is calculated as below:

$$L=A-B;$$

where A is the distance from the central axis 114 of the shaft 112 to the lift point 106, and B is the distance from the central axis 114 of the shaft 112 to the external surface 104*a* of the base cylinder section 108.

As the cam 102 rotates and the lift point 106 moves around the outer surface 104 of the cam 102, due to the external profile of the outer surface 104 of the cam 102, distance A will vary in accordance with the rotational orientation of the cam 102 with respect to the centre 114 of the shaft 112.

The lift, L, of the driveshaft assembly 100 varies between a maximum value, Lmax, and a minimum value of zero. As illustrated in FIGS. 3*a,* 5*a* and 7*a,* Lmax occurs when distance A is maximised and distance B is minimised. The minimum, zero value of lift occurs when distance A is equal to distance B, as illustrated in FIGS. 3*b,* 5*b* and 7*b.*

A maximum value of A is equal to the maximum distance between the central axis 114 of the shaft 112 and the outer surface 4*b* of the further section 110 of the cam 102.

The cam 102 assembled onto the shaft 112 at three of the eleven positions will be described below in greater detail.

Figure 3B:
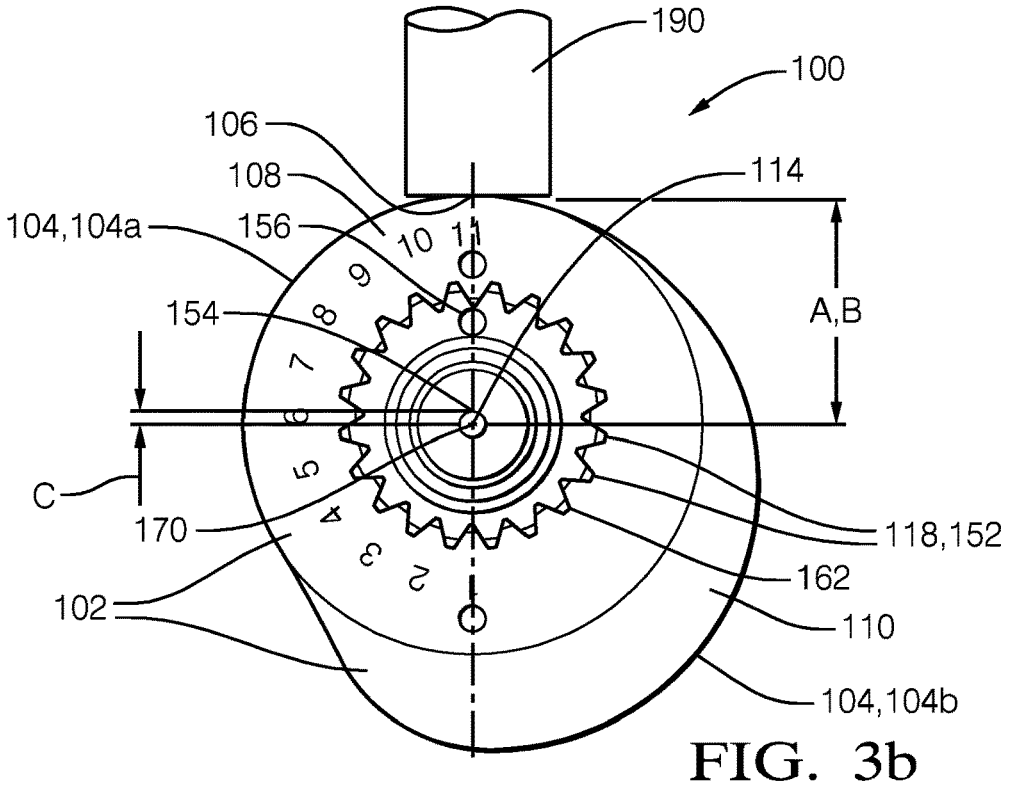

In FIGS. 3*a* and 3*b,* the cam 102 has been assembled onto the shaft 112 at position 11, providing a minimum value of Lmax, and therefore a minimum value of travel of the plunger 190.

In this position, the offset D of the central axis 170 of the base cylinder section 108, from the central axis 114 of the shaft 112, is zero, i.e. the central axes 170 and 114 are coincident.

FIG. 3*a* illustrates the driveshaft assembly 100 at the maximum lift position, i.e. wherein the value of distance A is maximised. FIG. 3*b* illustrates the driveshaft assembly 100 further around the rotational cycle, wherein distance A is at a minimum and is equal to distance B thereby providing an instantaneous lift value L of zero.

Figure 4:
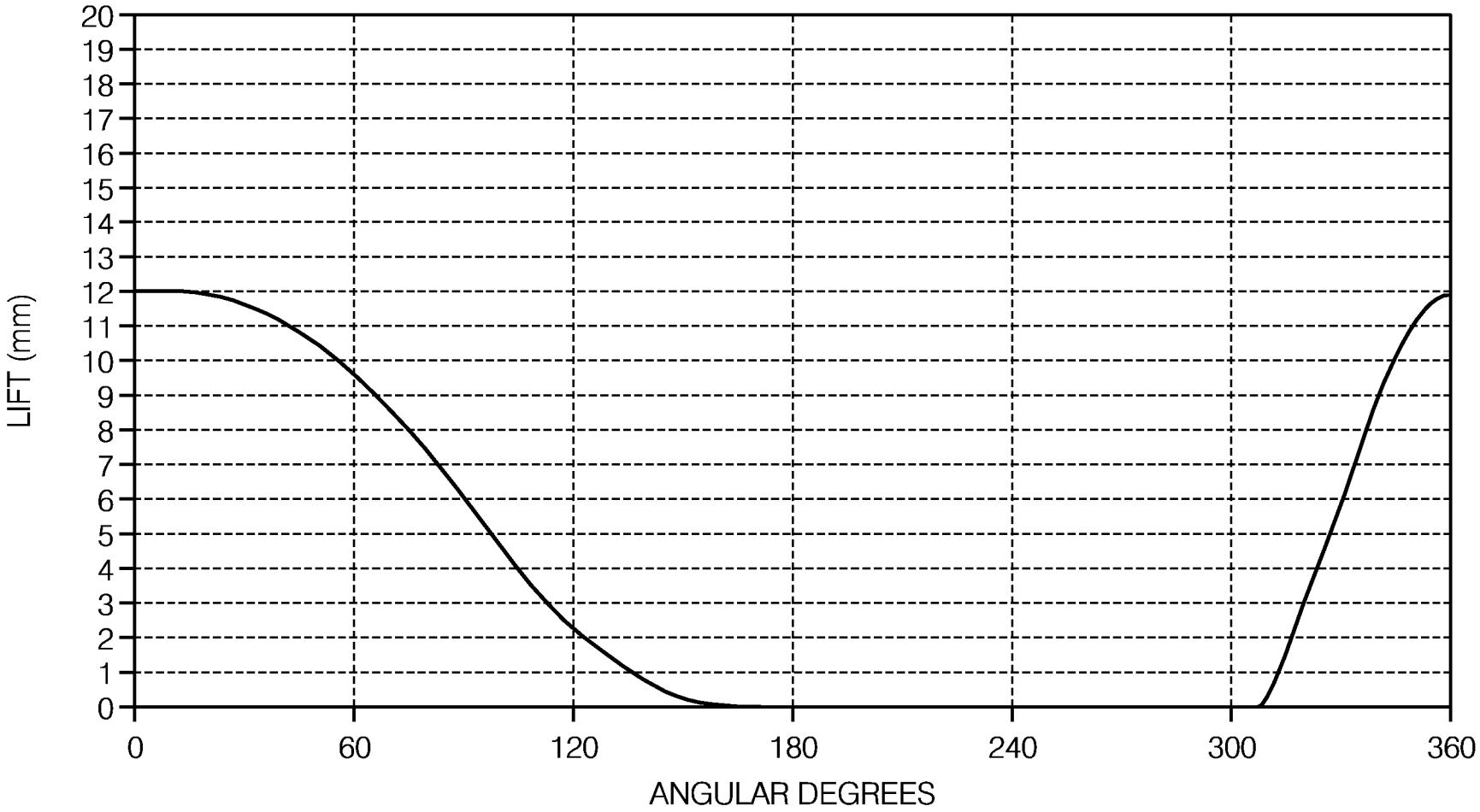
FIG. 4 is a graphical representation of a lift profile of the driveshaft assembly at the minimum lift position of FIGS. 3*a* and 3*b;*

FIG. 4 provides an example of a lift profile during rotation, of the driveshaft assembly 100 when the cam 102 is located on the shaft in position 11, and wherein the offset C, (of the central axis 154 of the splined section 162 and the central axis 114 of the shaft 112), is 1.5 mm. (The maximum value of offset D for this arrangement is also 1.5 mm). The lift L varies between zero and an Lmax value of 12 mm.

Figure 5B:
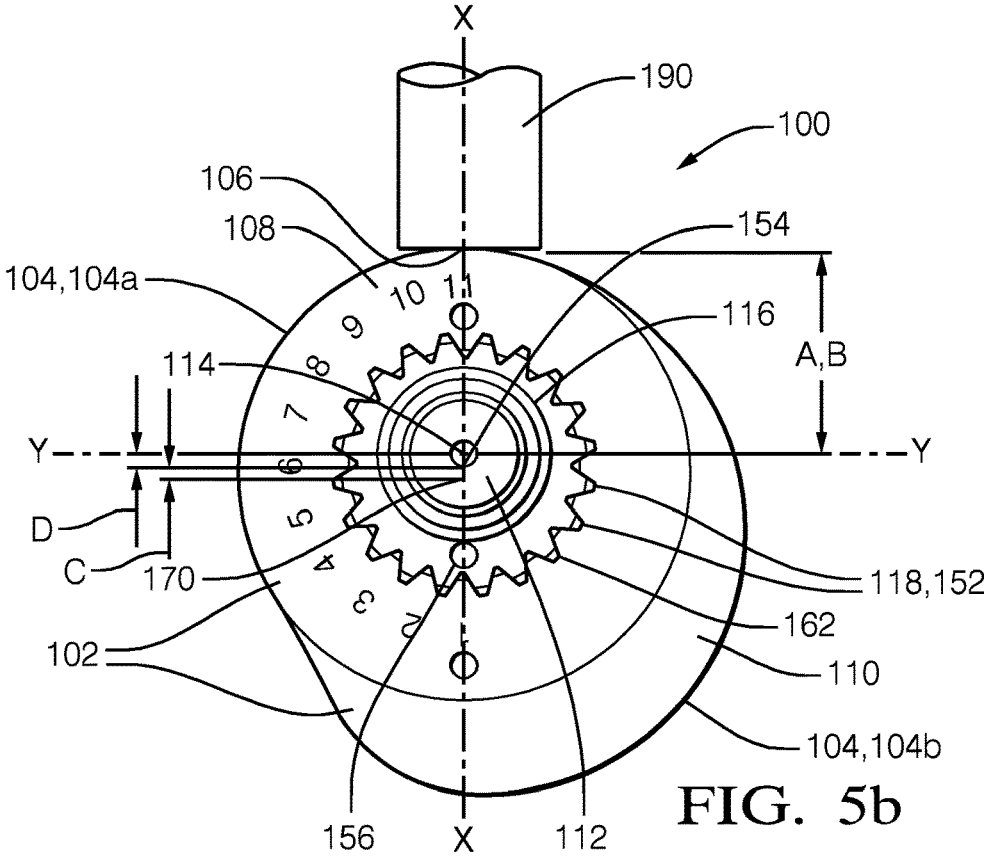

In FIGS. 5*a* and 5*b,* the cam 102 has been assembled onto the shaft 112 in position 1, wherein the cam 102 has been rotated 180° with respect to the position of FIGS. 3*a* and 3*b.* In this position, the driveshaft assembly 100 provides a maximum value of Lmax, and therefore a maximum travel of a plunger.

In the arrangement of FIGS. 5*a* and 5*b,* the central axis 170 of the base cylinder section 108 is offset from the central axis 114 of the shaft 112, by distance D, in the X axis.

Relative to the arrangement of FIGS. 3*a* and 3*b,* the maximum value of distance A (which occurs at the rotational position illustrated in FIG. 5*a*), has increased by both the offset values C and D, and maximum value of distance B, has decreased by both the offset values C and D. Accordingly, Lmax, which occurs at the rotational position of FIG. 5*a,* is maximised.

FIG. 5*b* illustrates the driveshaft assembly 100 in position 1, further around the cycle, when distance A is equal to distance B, and instantaneous lift L is therefore zero.

Figure 6:
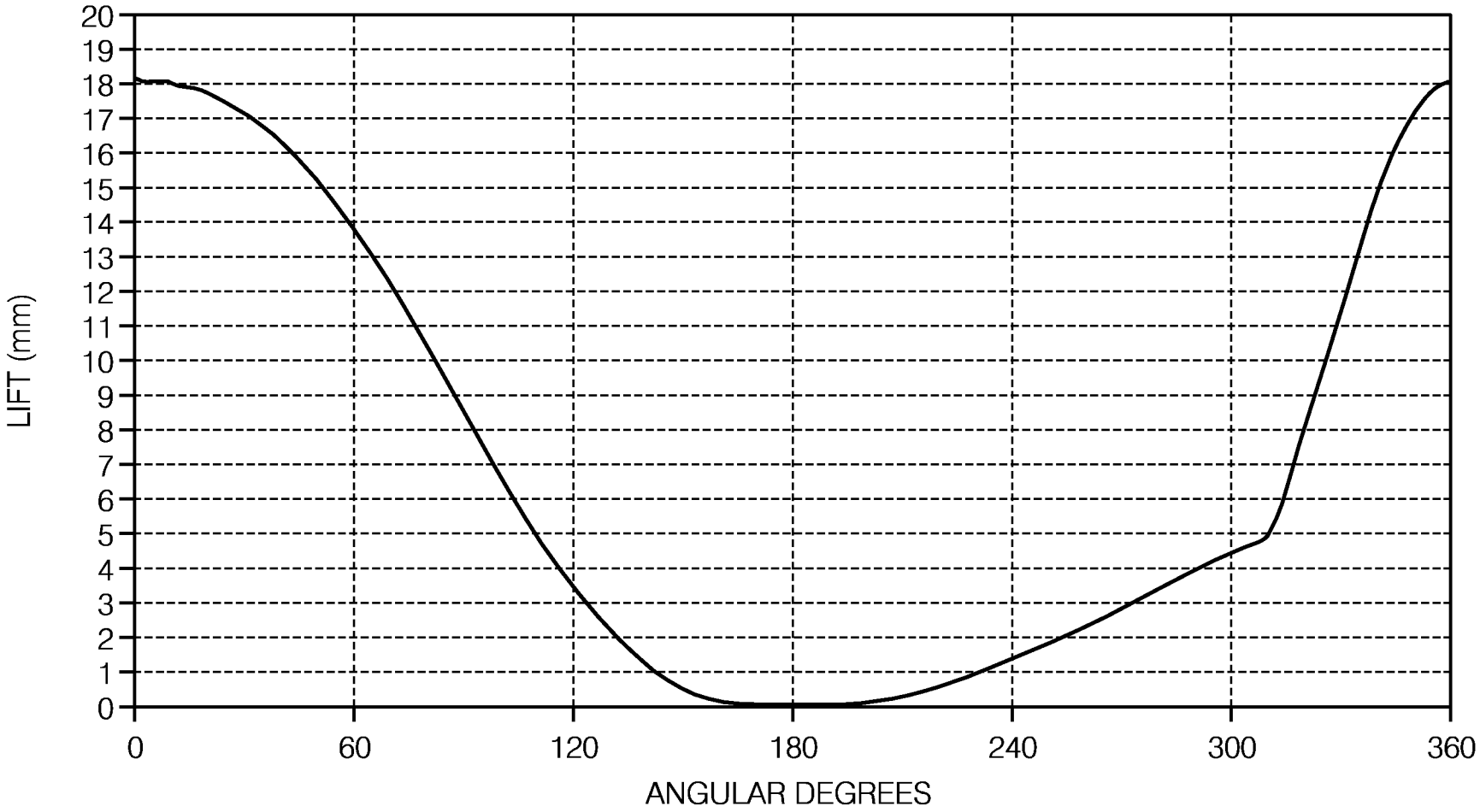
FIG. 6 is a graphical representation of a lift profile of the driveshaft assembly at the maximum lift position of FIGS. 5*a* and 5*b;*

FIG. 6 corresponds to FIG. 4, and illustrates the lift profile of the same embodiment of driveshaft assembly 100 when the cam 102 has been assembled onto the shaft 112 in position 1. As illustrated, the maximum value of lift, Lmax, is now 18 mm, an increase of 6 mm relative to the arrangement of FIGS. 3*a* and 3*b.*

Figure 7B:
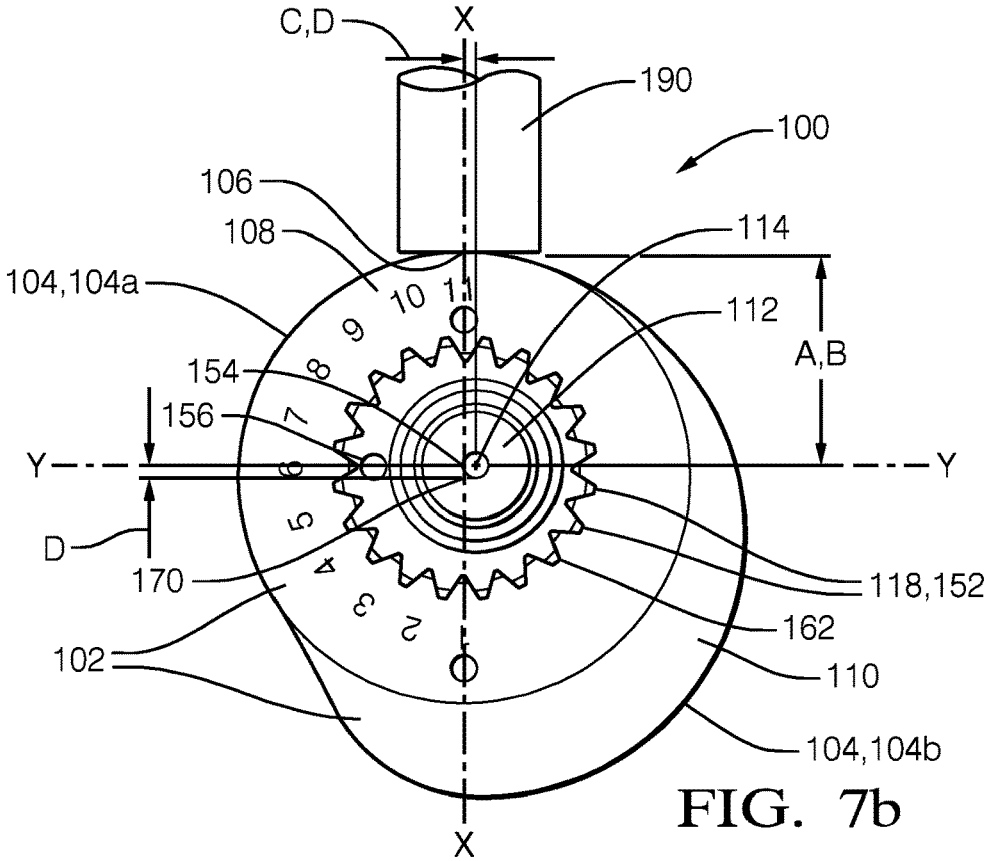

In FIGS. 7*a* and 7*b,* the cam 102 has been assembled onto the shaft 112 in position 6, wherein the cam 102 has been rotated 90° with respect to the position of FIGS. 3*a* and 3*b.* In this position, the driveshaft assembly 100 provides a mid-value of Lmax and therefore a mid-value of travel of the plunger 190.

In the position of FIGS. 7*a* and 7*b,* the central axis 170 of the base cylinder portion 108 is offset by distance D from the centre of rotation 114 of the shaft 112, in both the X and Y axes.

Figure 8:
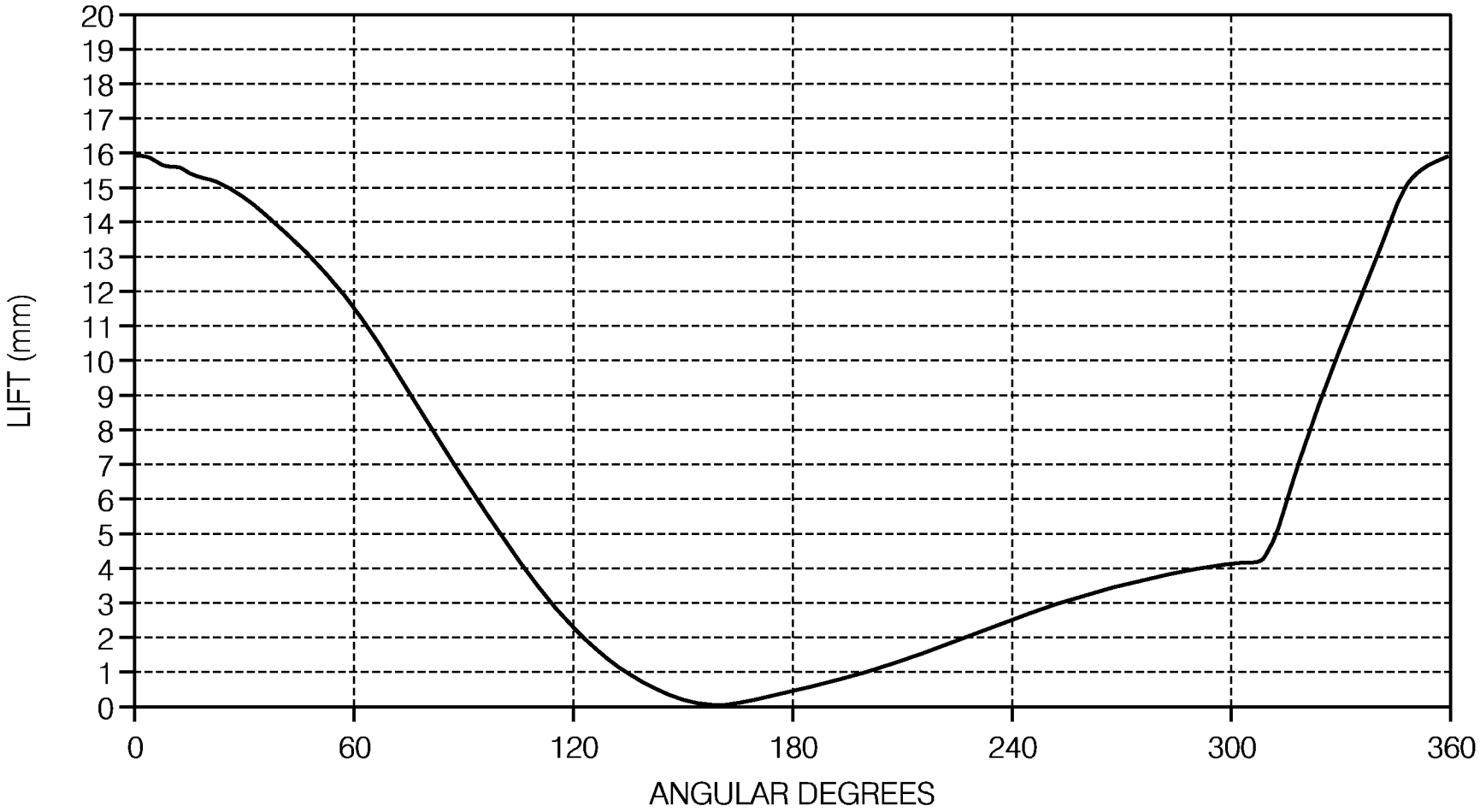
FIG. 8 is a graphical representation of a lift profile of the driveshaft assembly at the mid-Lmax position of FIGS. 7*a* and 7*b;*.

FIG. 8 corresponds to FIGS. 4 and 6, and illustrates the lift profile of the same embodiment of driveshaft assembly 100, when the cam 102 has been assembled onto the shaft 112 in position 6. As illustrated, the maximum value of lift Lmax is now 15.5 mm, i.e. between the Lmax values of FIGS. 4 and 6.

Examples of the values of A, B and L for a driveshaft 100 in accordance with the present invention, in the three positions described above, are provided in the table below, wherein the offsets C and D are each 1.5 mm. The values of L are instantaneous values at the rotational position illustrated in each Figure.

| | A (mm) | B (mm) | L (mm) |
|---|---|---|---|
| FIG. 3a | 42 | 30 | 12 (Lmax) |
| FIG. 3b | 30 | 30 | 0 |
| FIG. 5a | 45 | 27 | 18 (Lmax) |
| FIG. 5b | 27 | 27 | 0 |
| FIG. 7a | 43.5 | 28.5 | 15 (Lmax) |
| FIG. 7b | 28.5 | 28.5 | 0 |

In the embodiments described above, the cam 102 acts directly on the plunger 190. Alternatively, the cam 102 could act indirectly on the plunger 190, via a rocker arm.

The present invention can replace any driveshaft embodiment. One particular use could be for a testing machine for a fuel injector or pump such as an UI, EUI or EUP. An example of a machine 200 for testing an injector 300 is illustrated FIG. 9, and comprises a driveshaft assembly 101 in accordance with the present invention. The cam 102 is housed in a cambox 210 comprising a cambox cover 208. The cambox 210 is mounted on a bedplate adapter 211 via an adapter plate 209.

The machine 200 further comprises a pressure plate 213 and injector support plate 212 into which the injector 300 is clamped and held in position by a locknut 203. A rotary drive is connected to the camshaft 112 and rotates the shaft 112 and cam 102, for example at speeds of 30 to 4000 rpm, which causes a cam follower 205 and hence a pressurising plunger (not shown) of the injector 300 to move in a reciprocating motion. The plunger generates an increasing fuel pressure within the injector 300 when an electronically operated spill valve (not shown) is closed. A nozzle (not shown) of the injector 300 is caused to open when fuel pressure within the injector 300 reaches a predetermined threshold.

During operation, the machine 200 measures parameters of the injector 300 such as injected fuel quantity.

The machine 200 may be used to test different types of injector or pump which have plungers requiring different values of maximum lift Lmax. The driveshaft assembly 101 of the present invention enables the machine to test different injector/pump types having different Lmax requirements, without requiring the fitting of different cams/cam follower combinations to the machine.

In the above embodiments, the indexing means comprises cooperating splines provided on the shaft and on the bore of the cam. In alternative embodiments of the present invention, alternative indexing means could be used.

Furthermore, alternative embodiments could enable a different number of discreet indexed positions, and therefore a different number of possible values of Lmax. For example, a different number of splines would enable a different number of discreet positional arrangements of the cam onto the shaft.

REFERENCES driveshaft assembly 100
cam 102
cam outer surface 104
base cylinder section outer surface 104*a*
further section outer surface 104*b*
lift point 106
base cylinder section 108
cam further section 110
shaft 112
shaft central axis 114
bore 116
internal splines 118
shaft annular section 150
external splines 152
splined section central axis 154
position indicator 156
splined section 162
base cylinder longitudinal central axis 170
increased diameter shaft annular section 180
plunger 190
offset C
maximum value of lift Lmax
plunger movement P
variation of base cylinder central axis D
axes X, Y
offset Y
cam shaft relative positions 1-11
distance central axis of shaft to lift point A
distance central axis of shaft to external surface base cylinder section B
machine 200
locknut 203
cam follower 205
cambox cover 208
adapter plate 209
cambox 210
bedplate adapter 211
pressure plate 213
injector support plate 212
injector 300

The invention claimed is:

1. A driveshaft assembly for imparting lift to a plunger, the driveshaft assembly comprising:
a cam; and
a shaft;
the cam comprising a base cylinder section and an integral further section which is eccentric to the base cylinder section, wherein an outer profile of the cam is defined partly by an outer surface of the base cylinder section and partly by an outer surface of the further section;
wherein the shaft is insertable through a through bore provided in the base cylinder section of the cam thereby to form the driveshaft assembly;
wherein the driveshaft assembly further comprises an indexing means, which enable the cam to be assembled onto the shaft at a plurality of rotational positions, wherein at each rotational position, a central axis of the base cylinder section is offset from a central axis of the shaft by a different offset value;
wherein the indexing means comprises splines;
wherein the splines comprise a first annular set of splines provided on an internal surface of the through bore of the cam, which correspond with a second annular set of splines provided on a section of the shaft,
wherein a centre of a circumference of the splines is offset from the central of the shaft; and
wherein the cam is a push fit onto the shaft, and wherein the plurality of rotational positions comprise a plurality of discreet rotational positions.

2. A driveshaft assembly as claimed in claim 1 wherein the offset value varies between zero and a maximum offset value.

3. A driveshaft assembly as claimed in claim 1 further comprising a position indicator, which indicates a relative position at which the cam has been assembled onto the shaft.

4. A driveshaft and plunger assembly comprising:
a cam;
a shaft; and
a plunger arranged for reciprocating movement caused by lift imparted by the cam during rotation of the shaft;
the cam comprising a base cylinder section and an integral further section which is eccentric to the base cylinder section, wherein an outer profile of the cam is defined partly by an outer surface of the base cylinder section and partly by an outer surface of the further section;
wherein the shaft is insertable through a through bore provided in the base cylinder section of the cam thereby to form the driveshaft assembly;
wherein the driveshaft assembly further comprises an indexing means, which enable the cam to be assembled onto the shaft at a plurality of rotational positions, wherein at each rotational position, a central axis of the base cylinder section is offset from a central axis of the shaft by a different offset value;
wherein the indexing means comprises splines;
wherein the splines comprise a first annular set of splines provided on an internal surface of the through bore of the cam, which correspond with a second annular set of splines provided on a section of the shaft
wherein a centre of a circumference of the splines is offset from the central axis of the shaft; and
wherein the cam is a push fit onto the shaft, and wherein the plurality of rotational positions comprise a plurality of discreet rotational positions.

5. A driveshaft and plunger assembly as claimed in claim 4 further comprising a position indicator, which indicates a relative position at which the cam has been assembled onto the shaft.

6. A machine for testing a fuel injector or a pump having a plunger, the machine comprising:
a driveshaft assembly having a cam and a shaft;
the cam comprising a base cylinder section and an integral further section which is eccentric to the base cylinder section, wherein an outer profile of the cam is defined partly by an outer surface of the base cylinder section and partly by an outer surface of the further section;
wherein the shaft is insertable through a through bore provided in the base cylinder section of the cam thereby to form the driveshaft assembly;
wherein the driveshaft assembly further comprises an indexing means, which enable the cam to be assembled onto the shaft at a plurality of rotational positions, wherein at each rotational position, a central axis of the base cylinder section is offset from a central axis of the shaft by a different offset value; and
wherein the driveshaft assembly causes reciprocating movement of the plunger of the fuel injector or the pump;
wherein the indexing means comprises splines:
wherein the splines comprise a first annular set of splines provided on an internal surface of the through bore of the cam, which correspond with a second annular set of splines provided on a section of the shaft wherein a centre of a circumference of the splines is offset from the central axis of the shaft: and wherein the cam is a push fit onto the shaft and wherein the plurality of rotational positions comprise a plurality of discreet rotational positions.

7. A machine as claimed in claim 6 further comprising a position indicator, which indicates a relative position at which the cam has been assembled onto the shaft.

* * * * *